US010167615B2

(12) United States Patent
Cho

(10) Patent No.: US 10,167,615 B2
(45) Date of Patent: Jan. 1, 2019

(54) CONTROL SYSTEM FOR CONSTRUCTION MACHINERY AND CONTROL METHOD FOR CONSTRUCTION MACHINERY USING THE SAME

(71) Applicant: Doosan Infracore Co., Ltd., Incheon (KR)

(72) Inventor: Yong-Lak Cho, Incheon (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 262 days.

(21) Appl. No.: 15/169,947

(22) Filed: Jun. 1, 2016

(65) Prior Publication Data

US 2016/0356020 A1 Dec. 8, 2016

(30) Foreign Application Priority Data

Jun. 2, 2015 (KR) ..... 10-2015-0078091

(51) Int. Cl.
*E02F 9/12* (2006.01)
*E02F 9/22* (2006.01)
*E02F 3/42* (2006.01)

(52) U.S. Cl.
CPC ..... *E02F 9/2285* (2013.01); *E02F 9/123* (2013.01); *E02F 9/2203* (2013.01); *E02F 9/2242* (2013.01); *E02F 9/2282* (2013.01); *E02F 9/2292* (2013.01); *E02F 3/42* (2013.01); *F15B 2211/20576* (2013.01); *F15B 2211/3059* (2013.01); *F15B 2211/6658* (2013.01); *F15B 2211/7058* (2013.01);
(Continued)

(58) Field of Classification Search
CPC . F15B 11/162; F15B 11/165; F15B 2211/781; F15B 2211/3059; E02F 9/123; E02F 9/2203
See application file for complete search history.

(56) References Cited

U.S. PATENT DOCUMENTS

2014/0245730 A1 9/2014 Joung et al.
2016/0251833 A1 9/2016 Kondo et al.

FOREIGN PATENT DOCUMENTS

CN 202347574 U 7/2012
CN 203188273 U 9/2013
JP 2015086959 A 5/2015

OTHER PUBLICATIONS

Chinese Office Action dated Dec. 26, 2017 from the State Intellectual Property Office of China (SIPO) issued in corresponding Chinese Patent Application No. 201610380565.6 (7 Pages).

*Primary Examiner* — F Daniel Lopez
*Assistant Examiner* — Daniel S Collins
(74) *Attorney, Agent, or Firm* — K&L Gates LLP

(57) ABSTRACT

A control system for construction machinery includes first and second hydraulic pumps connected to an engine, a swing control valve and a first boom control valve installed in a first center bypass line connected to the first hydraulic pump, a second boom control valve installed in a second center bypass line connected to the second hydraulic pump, a shutoff valve installed in a control line through which a boom raising pilot signal pressure is supplied to the first boom control valve and configured to selectively open and close the control line, and a control unit configured to electronically control the shutoff valve according to a manipulation signal, wherein the control unit closes the shutoff valve such that the first boom control valve is shifted to a neutral position when a swing operation priority mode is selected.

13 Claims, 11 Drawing Sheets

(52) U.S. Cl.
CPC ..... *F15B 2211/7135* (2013.01); *F15B 2211/7142* (2013.01); *F15B 2211/781* (2013.01)

CONTROL SYSTEM FOR CONSTRUCTION MACHINERY AND CONTROL METHOD FOR CONSTRUCTION MACHINERY USING THE SAME

PRIORITY STATEMENT

This application claims priority under 35 U.S.C. § 119 to Korean Patent Application No. 10-2015-0078091, filed on Jun. 2, 2015 in the Korean Intellectual Property Office (KIPO), the contents of which are herein incorporated by reference in their entirety.

FIELD OF TECHNOLOGY

Example embodiments relate to a control system for construction machinery and a control method for construction machinery using the same. More particularly, example embodiments relate to a control system for construction machinery including a boom cylinder and a swing motor, and a control method for construction machinery using the same.

BACKGROUND

Construction machinery may use a hydraulic fluid to drive actuators such as a boom, a cylinder, a bucket, a travelling motor, a swing motor, etc. In the large construction machinery, at least three main hydraulic pumps may be used to discharge more hydraulic fluid, thereby obtaining a much more driving power.

Especially, a separate main hydraulic pump may be provided only for a swing operation. Alternatively, a hydraulic fluid discharged from one main hydraulic pump may be distributed to different actuators to perform a multiple swing operation, for example, the swing operation and another operation together.

SUMMARY

Example embodiments provide a control system for construction machinery capable of efficiently performing a swing operation and a boom raising operation together.

Example embodiments provide a control system for construction machinery capable of performing a swing priority operation while securing independence of a swing operation.

According to example embodiments, a control system for construction machinery includes first and second hydraulic pumps connected to an engine, a swing control valve and a first boom control valve installed in a first center bypass line connected to the first hydraulic pump and connected parallel with each other to the first hydraulic pump by a parallel line, the swing control valve configured to control a drive of a swing motor, the first boom control valve configured to control a drive of a boom cylinder, a second boom control valve installed in a second center bypass line connected to the second hydraulic pump, the second boom control valve configured to control the drive of the boom cylinder, a shutoff valve installed in a control line through which a boom raising pilot signal pressure for raising a boom of the boom cylinder is supplied to the first boom control valve and configured to selectively open and close the control line, and a control unit configured to electronically control the shutoff valve according to a manipulation signal in the construction machinery, wherein the control unit closes the shutoff valve such that the first boom control valve is shifted to a neutral position when a swing operation priority mode is selected.

In example embodiments, the swing control valve may be installed in the most upstream portion of the first center bypass line towards the first hydraulic pump.

In example embodiments, the control system may further include at least one actuator control valve configured to control a drive of an actuator in the construction machinery. The actuator control valve may be installed in the first center bypass line downstream next to the swing control valve and the first boom control valve, In example embodiments, the actuator control valve may be connected in series with the swing control valve and the first boom control valve.

In example embodiments, the control system may further include a third hydraulic pump connected to the engine, and a third boom control valve installed in a third center bypass line connected to the third hydraulic pump, the third boom control valve configured to control the drive of the boom cylinder.

In example embodiments, the control unit may include a selection switch for selecting the swing operation priority mode, and a controller configured to receive the manipulation signal in the construction machinery and a selection signal from the selection switch and apply a current to the shutoff valve.

In example embodiments, the control unit may further include a first pressure sensor configured to detect a boom raising pilot signal pressure supplied to the second boom control valve in order to raise the boom of the boom cylinder, and a second pressure sensor configured to detect a swing pilot signal pressure supplied to the swing control valve in order to drive the swing motor.

In example embodiments, the control unit may open the shutoff valve when receiving a boom raising manipulation signal from the first pressure sensor in case that the swing operation priority mode is not selected.

In example embodiments, the control system may further include a pilot pump connected to the engine, and a pressure generating device configured to receive a control fluid from the pilot pump and generate the boom raising pilot signal pressure and the swing pilot signal pressure corresponding to the manipulation signal.

In example embodiments, the pressure generating device may include a joystick.

In example embodiments, the shutoff valve may include electronic proportional pressure reducing (EPPR) valve.

In example embodiments, the shutoff valve may include a solenoid valve.

According to example embodiments, a control system for construction machinery includes first and second hydraulic pumps connected to an engine, a swing control valve installed in an upstream portion of a first center bypass line connected to the first hydraulic pump, the swing control valve configured to control a drive of a swing motor, a first boom control valve installed downstream in the first center bypass line next to the swing control valve, the first boom control valve configured to control a drive of a boom cylinder, a second boom control valve installed in a second center bypass line connected to the second hydraulic pump, the second boom control valve configured to control the drive of the boom cylinder, a shutoff valve installed in a control line through which a boom raising pilot signal pressure for raising a boom of the boom cylinder is supplied to the first boom control valve and configured to selectively open and close the control line, and a control unit including a first pressure sensor for detecting a boom raising pilot signal pressure supplied to the second boom control valve, a second pressure sensor for detecting a swing pilot signal pressure supplied to the swing control valve, a selection switch for selecting a swing operation priority mode, and a controller configured to receive pressure information and a selection signal from the first and second pressure sensors and the selection switch and electronically control the shutoff valve, wherein the controller closes the shutoff valve such that the first boom control valve is shifted to a neutral position when the swing operation priority mode is selected. The swing control valve and the first boom control valve are connected parallel with each other to the first hydraulic pump by a parallel line.

According to example embodiments, there is provided a method for controlling construction machinery. In the method, manipulation information and swing operation priority mode selection information in construction machinery are obtained. A hydraulic fluid is supplied to a boom cylinder head when receiving a boom raising manipulation signal in case a swing operation priority mode is not selected. The hydraulic fluid is shut off to the boom cylinder head when receiving the boom raising operation manipulation signal and a swing operation manipulation signal in case the swing operation priority mode is selected.

In example embodiments, obtaining the manipulation information may include obtaining information of a boom raising pilot signal pressure supplied to a main control valve, and obtaining information of a swing pilot signal pressure supplied to the main control valve.

In example embodiments, shutting off the hydraulic fluid to the boom cylinder head may include blocking a boom raising pilot signal pressure from being supplied to the main control valve.

According to example embodiments, a control system for construction machinery may have a hydraulic circuit capable of driving a swing motor and a boom cylinder together using a hydraulic fluid discharged from one main hydraulic pump, thereby saving expenses and obtaining advantages in space.

Further, when an operator gives priority to a swing operation, a hydraulic fluid may be blocked from being supplied to the boom cylinder, to thereby secure independence of the swing operation.

BRIEF DESCRIPTION OF THE DRAWINGS

Example embodiments will be more clearly understood from the following detailed description taken in conjunction with the accompanying drawings.

FIG. 1 is a hydraulic circuit diagram illustrating a control system for construction machinery in accordance with example embodiments.

FIG. 2 is a hydraulic circuit diagram illustrating the control system for construction machinery in FIG. 1, when receiving a boom raising signal in case that a swing operation priority mode is not selected.

FIG. 3 is a hydraulic circuit diagram illustrating the control system for construction machinery in FIG. 1, when receiving a multiple manipulation signal of boom raising and swing operations in case that a swing operation priority mode is not selected.

FIG. 4 is a hydraulic circuit diagram illustrating the control system for construction machinery in FIG. 1, when receiving a multiple manipulation signal of boom raising and swing operations in case that a swing operation priority mode is selected.

FIG. 5 is a hydraulic circuit diagram illustrating the control system for construction machinery in FIG. 1, when receiving only a swing operating signal without a boom raising signal.

FIG. 6 is a hydraulic circuit diagram illustrating a control system for construction machinery in accordance with example embodiments.

FIG. 7 is a hydraulic circuit diagram illustrating the control system for construction machinery in FIG. 6, when receiving a boom raising signal in case that a swing operation priority mode is not selected.

FIG. 8 is a hydraulic circuit diagram illustrating the control system for construction machinery in FIG. 6, when receiving a multiple manipulation signal of boom raising and swing operations in case that a swing operation priority mode is not selected.

FIG. 9 is a hydraulic circuit diagram illustrating the control system for construction machinery in FIG. 6, when receiving a multiple manipulation signal of boom raising and swing operations in case that a swing operation priority mode is selected.

FIG. 10 is a hydraulic circuit diagram illustrating the control system for construction machinery in FIG. 6, when receiving only a swing operating signal without a boom raising signal.

FIG. 11 is a flow chart illustrating a method of controlling construction machinery in accordance with example embodiments.

DETAILED DESCRIPTION

Figure 1:
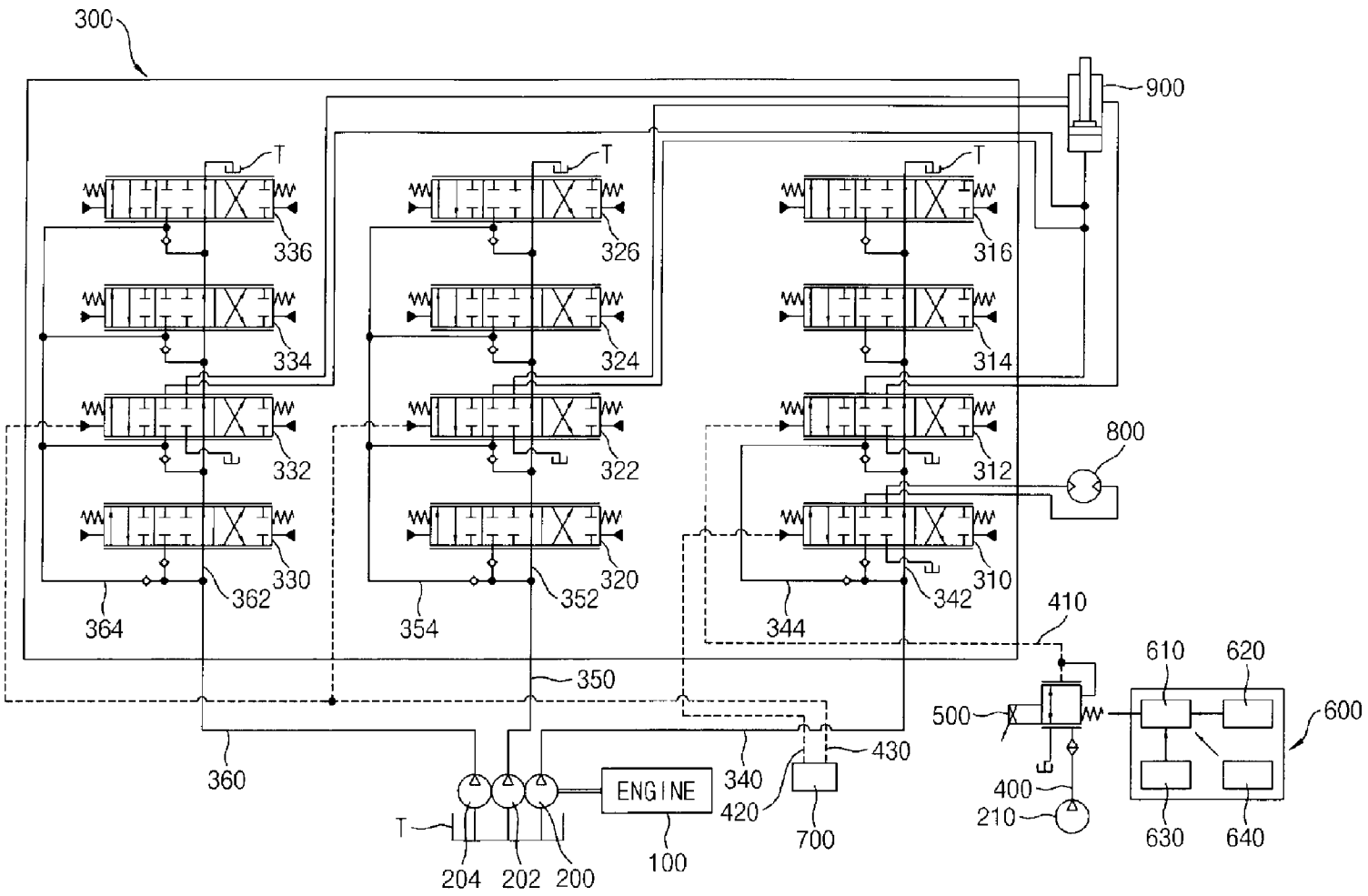
FIGS. 1 to 11 represent non-limiting, example embodiments as described herein.

Various example embodiments will be described more fully hereinafter with reference to the accompanying drawings, in which example embodiments are shown. Example embodiments may, however, be embodied in many different forms and should not be construed as limited to example embodiments set forth herein. Rather, these example embodiments are provided so that this disclosure will be thorough and complete, and will fully convey the scope of example embodiments to those skilled in the art. In the drawings, the sizes and relative sizes of components or elements may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element or layer is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, example embodiments will be explained in detail with reference to the accompanying drawings.

Figure 2:
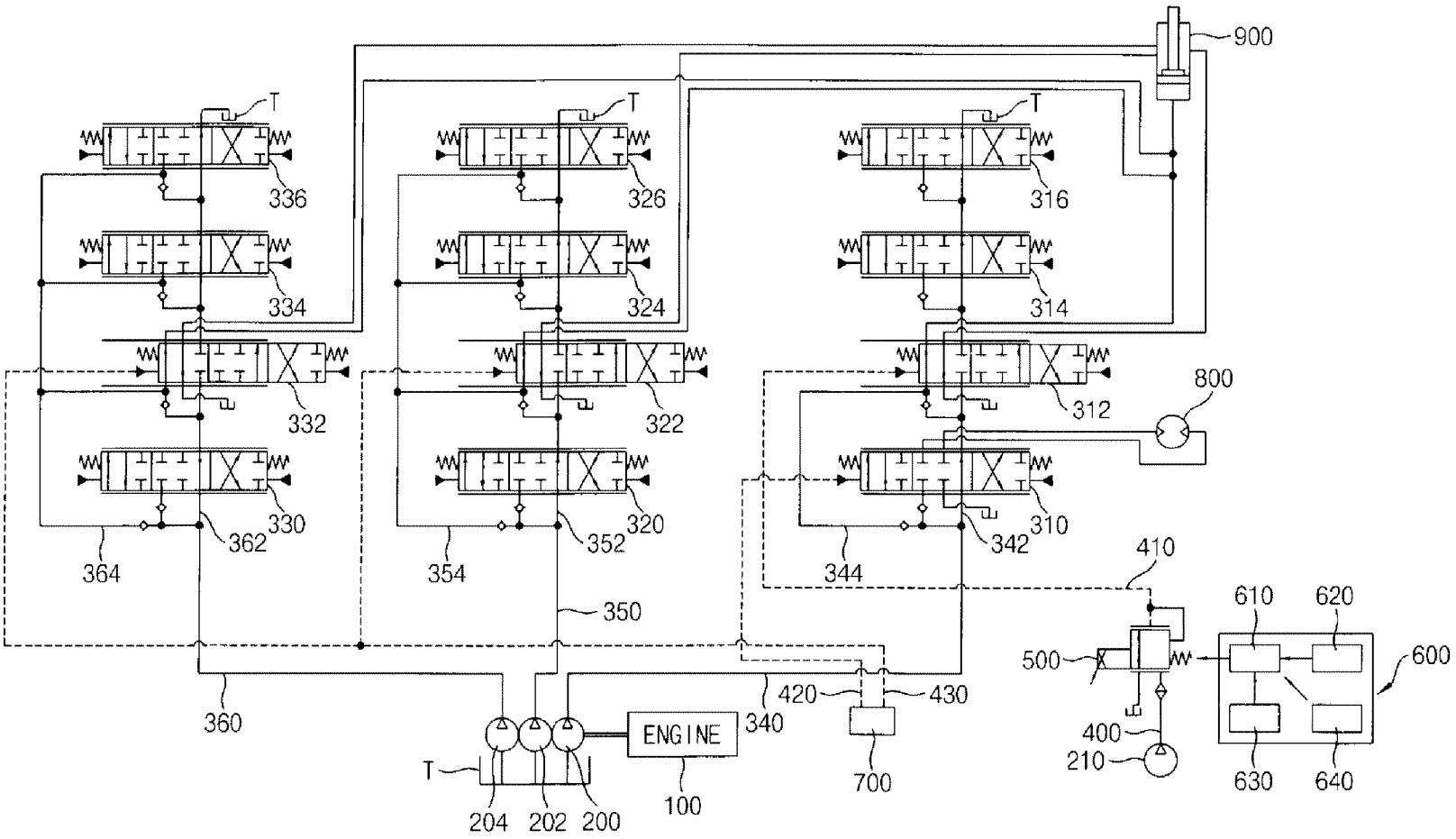
Figure 3:
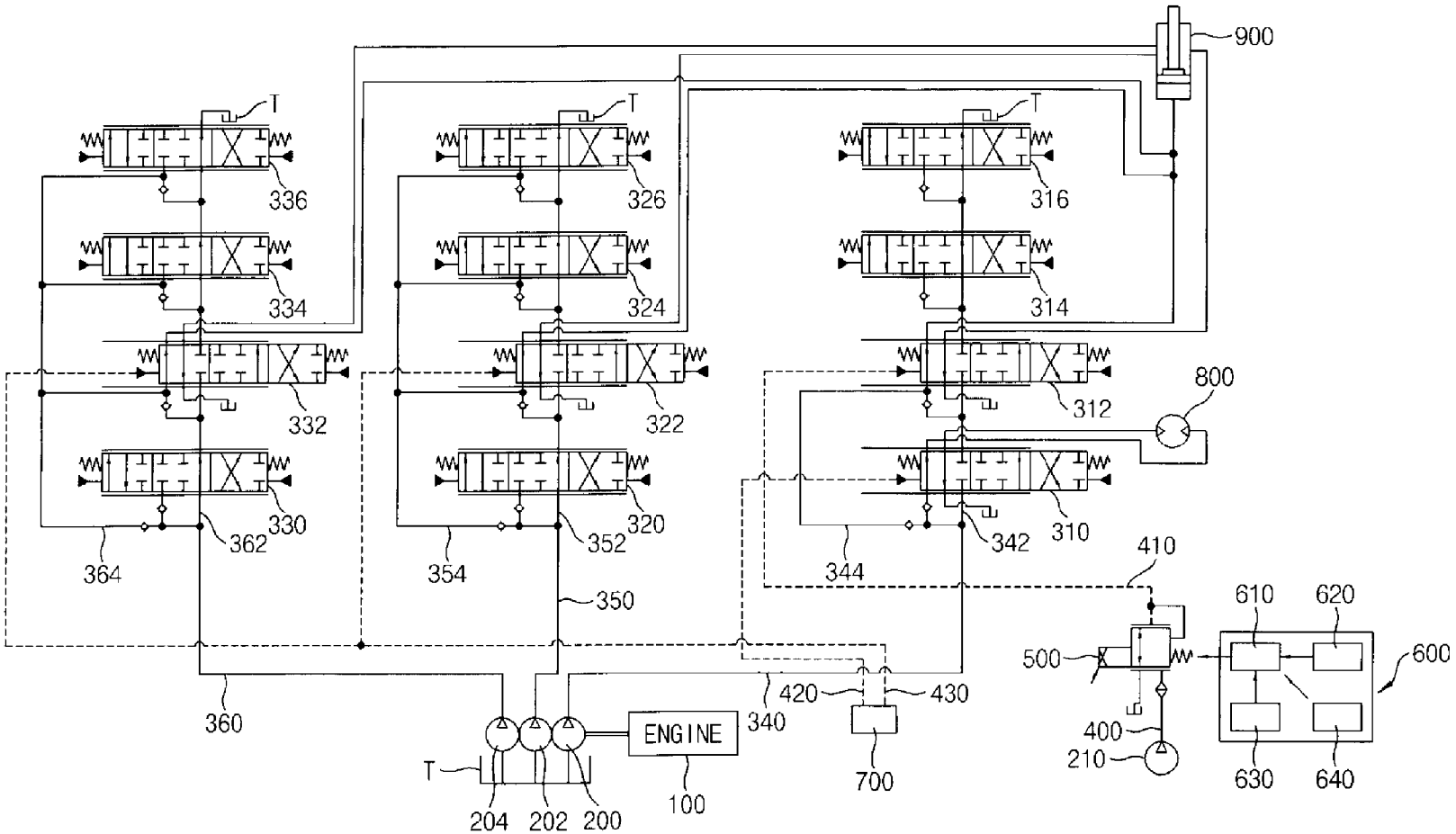
Figure 4:
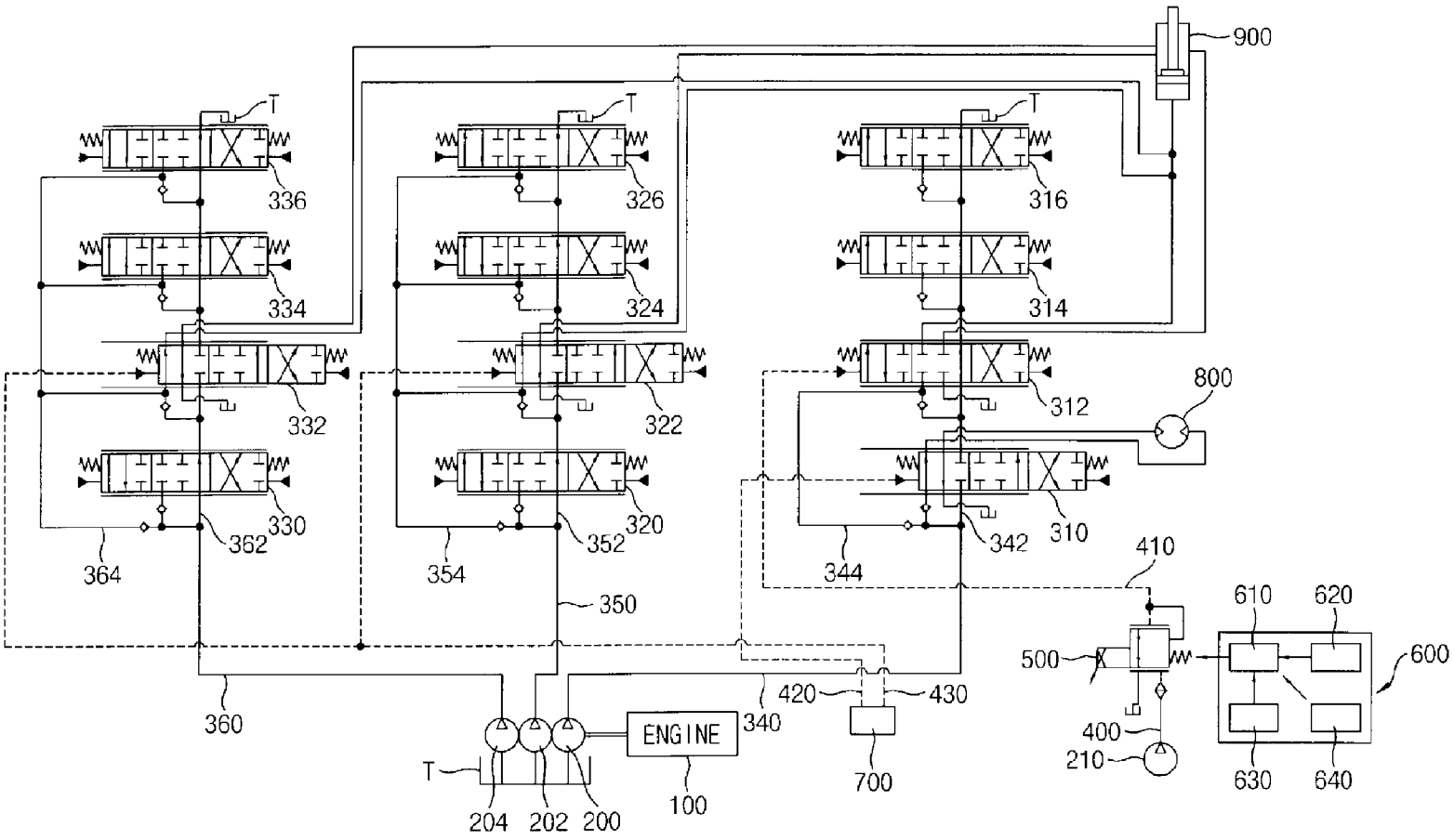
Figure 5:
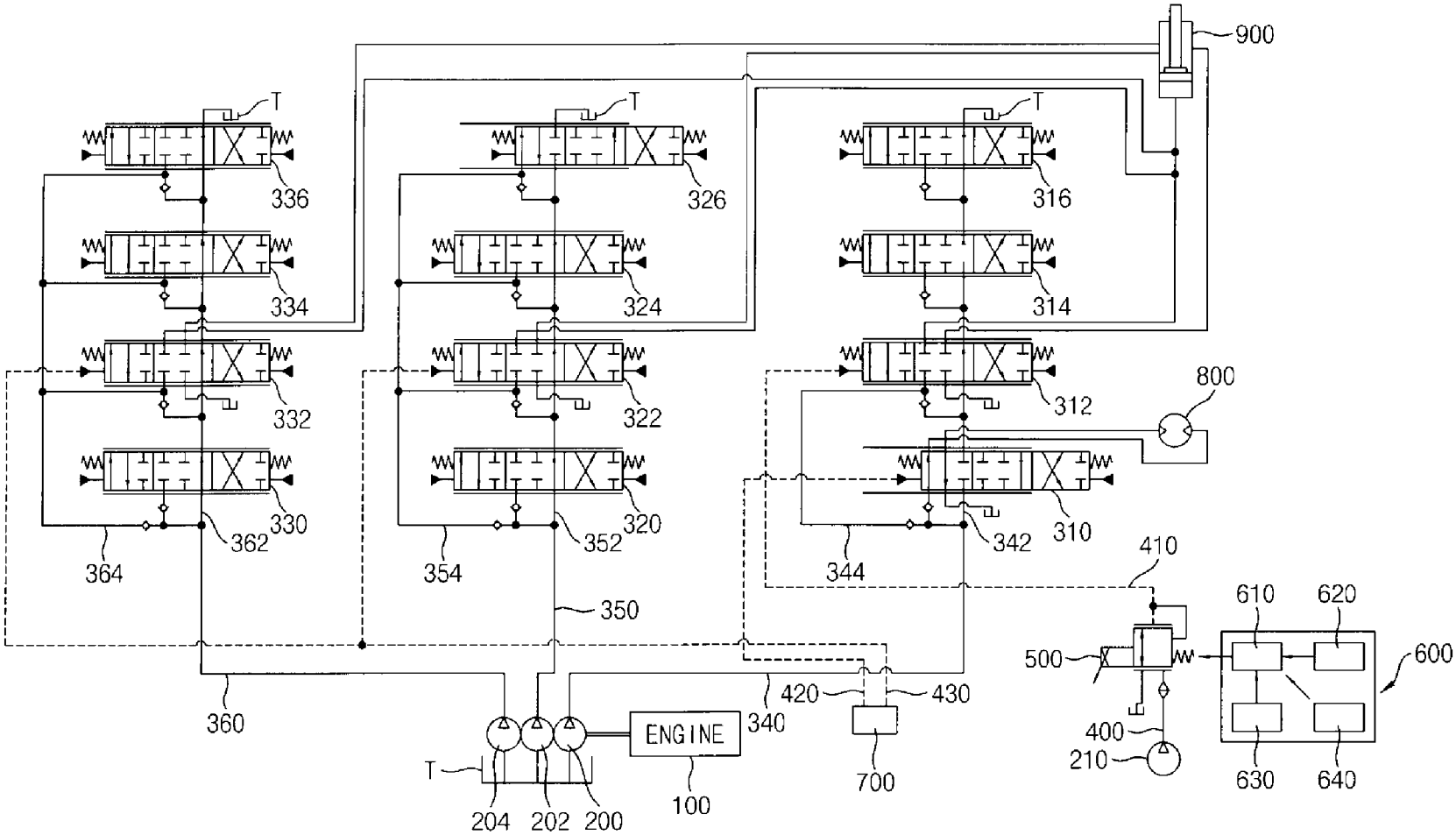

FIG. 1 is a hydraulic circuit diagram illustrating a control system for construction machinery in accordance with example embodiments. FIG. 2 is a hydraulic circuit diagram illustrating the control system for construction machinery in FIG. 1, when receiving a boom raising signal in case that a swing operation priority mode is not selected. FIG. 3 is a hydraulic circuit diagram illustrating the control system for construction machinery in FIG. 1, when receiving a multiple manipulation signal of boom raising and swing operations in case that a swing operation priority mode is not selected. FIG. 4 is a hydraulic circuit diagram illustrating the control system for construction machinery in FIG. 1, when receiving a multiple manipulation signal of boom raising and swing operations in case that a swing operation priority mode is selected. FIG. 5 is a hydraulic circuit diagram illustrating the control system for construction machinery in FIG. 1, when receiving only a swing operating signal without a boom raising signal.

Referring to FIGS. 1 to 5, a control system for construction machinery according to example embodiments may include first to third hydraulic pumps 200, 202 and 204 and a pilot pump 210 connected to an engine 100, a main control valve 300 configured to adjust a flow of a hydraulic fluid from the first to third hydraulic pumps 200, 202 and 204 to control operations of actuators in the construction machinery, a pressure generating device 700 configured to receive a control fluid from the pilot pump 210 and generate a pilot signal pressure for controlling the main control valve 300, a shutoff valve 500 configured to selectively open and close a first boom raising control line 410 through which a boom raising pilot signal pressure is applied to a first boom control valve 312 of the main control valve 300, and a control unit 600 configured to electronically control the shutoff valve 500.

An output power of the engine 100 may be transmitted to the first to third hydraulic pumps 200, 202 and 204 respectively. The first to third hydraulic pumps 200, 202 and 204 may discharge the hydraulic fluid from an oil tank T to the actuators via the main control valve 300. Examples of the actuators may be a boom cylinder 900, an arm cylinder (not illustrated), a bucket cylinder (not illustrated), a swing motor 800, a travelling motor (not illustrate), etc.

The hydraulic fluid from the first to third hydraulic pumps 200, 202 and 204 may be supplied to the actuators via the main control valve 300. The main control valve 300 may include a plurality of control valves. The hydraulic fluid may be supplied to the control valves through first to third hydraulic lines 340, 350 and 360. The first to third hydraulic lines 340, 350 and 360 may be connected to the first to third hydraulic pumps 200, 202 and 204 respectively.

The control valves may be installed in the first to third hydraulic lines 340, 350 and 360 respectively. The control valves may selectively open and close the first to third hydraulic lines 340, 350 and 360 according to a manipulation signal, to control the actuators. In particular, first and second travelling control valves 320 and 330 may control the drive of the travelling motor, first to third boom control valves 312, 322 and 332 may control the drive of the boom cylinder 900, first and second arm control valves 324 and 334 may control the drive of the arm cylinder, first and second bucket control valves 314 and 326 may control the drive of the bucket cylinder, and a swing control valve 310 may control the drive of the swing motor 800.

As illustrated in FIG. 1, the first hydraulic pump 200 may discharge the hydraulic fluid to the control valves through the first hydraulic line 340. The first hydraulic line 340 may be divided into a first center bypass line 342 and a first branch hydraulic line 344. The swing control valve 310, the first boom control valve 312, the first bucket control valve 314 and a first preliminary control valve 316 may be installed in series in the first center bypass line 342. The swing control valve 310 may be installed in the most upstream portion of the first center bypass line 342, and the first boom control valve 312, the first bucket control valve 314 and the first preliminary control valve 316 may be sequentially installed in the first center bypass line 342 downstream. In here, the upstream of the first center bypass line 342 may refer to a position further towards the first hydraulic pump 200 and the downstream of the first center bypass line 342 may refer to a position further away from the first hydraulic pump 200.

The swing control valve 310 and the first boom control valve 312 may be connected parallel with each other to the first hydraulic pump 200 by the first branch hydraulic line 344 such that the hydraulic fluid from the first hydraulic pump 200 may be supplied independently to the swing control valve 310 and the first boom control valve 312 respectively. On the other hand, because the first bucket control valve 314 and the first preliminary control valve 316 are connected in series to the first center bypass line 342, when the swing control valve 310 or the first boom control valve 312 is shifted, the first center bypass line 342 may be closed to restrict the flow rate of the hydraulic fluid from the first hydraulic pump 200 to the first bucket control valve 314 and the first preliminary control valve 316. In the case that there is no manipulation signal thereto, the hydraulic fluid from the first hydraulic pump 200 may return to the oil tank T through the first center bypass line 342.

The second hydraulic pump 202 may discharge the hydraulic fluid to the control valves through the second hydraulic line 350. The second hydraulic line 350 may be divided into a second center bypass line 352 and a second branch hydraulic line 354. The first travelling control valve 320, the second boom control valve 322, the first arm control valve 324 and the second bucket control valve 326 may be installed in series in the second center bypass line 352. The control valves 320, 322, 324 and 326 may be connected parallel with each other to the second hydraulic pump 202 by the second branch hydraulic line 354 such that the hydraulic fluid from the second hydraulic pump 202 may be supplied to the control valves 320, 322, 324 and 326 independently from each other. In the case that there is no manipulation signal thereto, the hydraulic fluid from the second hydraulic pump 202 may return to the oil tank T through the second center bypass line 352.

The third hydraulic pump 204 may discharge the hydraulic fluid to the control valves through the third hydraulic line 360. The second hydraulic line 360 may be divided into a third center bypass line 362 and a third branch hydraulic line 364. The second travelling control valve 330, the third boom control valve 332, the second arm control valve 334 and the second preliminary control valve 336 may be installed in series in the third center bypass line 362. The control valves 330, 332, 334 and 336 may be connected parallel with each other to the third hydraulic pump 204 by the third branch hydraulic line 364 such that the hydraulic fluid from the third hydraulic pump 204 may be supplied to the control valves 330, 332, 334 and 336 independently from each other. In the case that there is no manipulation signal thereto, the hydraulic fluid from the third hydraulic pump 204 may return to the oil tank T through the third center bypass line 362.

The output power of the engine 100 may be transmitted to the pilot pump 210. The pilot pump 210 may discharge the control fluid from the oil tank T to the control valves of the main control valve 300 via the pressure generating device 700 and a plurality of control lines, to thereby shift internal spools of the control valves. For example, the control fluid may be substantially the same as the hydraulic fluid.

As illustrated in FIG. 2, when an operator manipulates a boom lever for raising the boom, the pressure generating device 700 may generate a boom raising pilot signal pressure corresponding to a manipulation amount of the operator. The boom raising pilot signal pressure may be supplied to the second and third control valves 322 and 332 through a second boom raising control line 430. Thus, the second and third boom control valves 322 and 332 may be shifted to supply the hydraulic fluid to the boom cylinder 900.

Additionally, when receiving a boom raising signal from a first pressure sensor 630 in case that a swing operation priority mode is not selected by a selection switch 620, as mentioned below, the control unit 600 may open the shutoff valve 500, to supply a boom raising pilot signal pressure to the first boom control valve 312. Thus, the hydraulic fluid discharged from the first hydraulic pump 200 may be supplied to the boom cylinder 900, thereby obtaining a greater pump power than when only the second and third hydraulic pumps 202 and 204 are used to supply the hydraulic fluid to the boom cylinder 900.

Referring again to FIG. 1, the shutoff valve 500 may be installed in a control line 400 connected to the pilot pump 210, and may selectively open and close the first boom raising control line 410 through which the boom raising pilot signal pressure for extending the boom cylinder 900 is applied. The boom raising pilot signal pressure may be applied to the first boom control valve 312 to shift the internal spool of the first boom control valve 312.

When the shutoff valve 500 is closed, the boom raising pilot signal pressure may not be supplied to the first boom control valve 312. Accordingly, the first boom control valve 312 may be in a neutral position, the supply of the hydraulic fluid from the first hydraulic pump 200 may be shut off to the boom cylinder 900, and thus, the hydraulic fluid from the first hydraulic pump 200 may return to the oil tank T through the first center bypass line 342.

Alternatively, when the shutoff valve 500 is opened, the boom raising pilot signal pressure may be applied to the first boom control valve 312 through the first boom raising control line 410. Accordingly, the first boom control valve 312 may be shifted to the right on the drawing sheet, so that the hydraulic fluid from the first hydraulic pump 200 may be supplied to the boom cylinder 900.

In example embodiments, the shutoff valve 500 may include a proportional solenoid valve. The proportional solenoid valve may be electronic proportional pressure reducing (EPPR) valve.

The EPPR valve may vary a pressure of the control fluid in response to a current intensity. The control unit 600 may apply a current having intensity proportional to the boom raising pilot signal pressure supplied to the second boom raising control line 430 from the pressure generating device 700 to the EPPR valve. The EPPR valve may supply a pilot signal pressure proportional to the intensity of the applied current to the first boom control valve 312 through the first boom raising control line 410.

The control unit 600 may include the first pressure sensor 630 configured to detect a boom raising pilot signal pressure supplied to the second and third boom control valves 322 and 332, the second pressure sensor 640 configured to detect a swing pilot signal pressure supplied to the swing control valve 310, the selection switch 620 for selecting the swing operation priority mode, and a controller 610 configured to receive a manipulation signal from the first and second pressure sensors 630 and 640 and a selection signal from the selection switch 620 and apply a current to the shutoff valve 500.

The first pressure sensor 630 may be installed in the second boom raising control line 430 and may detect a boom raising pilot signal pressure supplied to the second and third boom control valves 322 and 332 from the pressure generating device 700 in response to a boom raising operation manipulation of an operator.

The second pressure sensor 640 may be installed in the swing control line 420 and may detect a swing pilot signal pressure supplied to the swing control valve 310 from the pressure generating device 700 in response to a swing operation manipulation of an operator.

If the selection switch 620 turns on, a swing operation priority mode is selected. If the selection switch 620 turns off, the swing operation priority mode is not selected.

The controller 610 may receive the manipulation signal from the first pressure sensor 630 and the second pressure sensor 640, may receive the selection signal from the selection switch 620, and may electronically control the shutoff valve 620.

As illustrated in FIG. 3, when the controller 610 receives a boom raising operation manipulation signal and a swing operation manipulation signal from the first and second pressure sensors 630 and 640 in case that an operator turns off the selection switch 620 such that a swing operation priority mode is not selected, the controller 610 may control to open the shutoff valve 500. In this case, the controller 610 may apply a current to the shutoff valve 500 such that a boom raising pilot signal pressure substantially the same as a boom raising pilot signal pressure supplied to the second boom raising control line 430 is supplied to the first boom raising control line 410. The shutoff valve 500 may vary an opening rate of the first boom raising control line 410 in proportion to the applied current so that the boom raising pilot signal pressure may be supplied to the first boom control valve 312. Additionally, the control fluid discharged from the pilot pump 210 may be supplied to the swing control valve 310 via the pressure generating device 700 and the swing control line 420. Then, the swing control valve 310 may be shifted to supply the hydraulic fluid from the first hydraulic pump 200 to the swing motor 800. That is, the hydraulic fluid from the first hydraulic pump 200 may be used to drive the swing motor 800 and the boom cylinder 900.

Alternatively, as illustrated in FIG. 4, in case that an operator turns on the selection switch 620 such that the swing operation priority mode is selected, the controller 610 may control to close the shutoff valve 500 such that the boom raising pilot signal pressure may not be supplied to the first boom control valve 312. Accordingly, the first boom control valve 312 may be shifted to a neutral position, and all the hydraulic fluid from the first hydraulic pump 200 may be used to drive the swing motor 800.

That is, when an operator selects the swing operation priority mode, regardless of the manipulation signals inputted from the first and second pressure sensors 630 and 640, the shutoff valve 500 may be closed and thus independence of the swing operation may be obtained.

As illustrated in FIG. 5, when an operator manipulates a swing lever and a bucket lever for a bucket crowd operation without a boom raising manipulation, all the hydraulic fluid from the first hydraulic pump 200 may be supplied to the swing motor 800.

In particular, the swing control valve 310, the first boom control valve 312 and the first bucket control valve 314 may be installed in the first center bypass line 342 divided from the first hydraulic line 340, and the swing control valve 310 and the first boom control valve 312 may be connected parallel with each other to the first hydraulic pump 200 by the first branch hydraulic line 344. Accordingly, when a pilot signal pressure is supplied to any one of the first swing control valve 310 or the first boom control valve 312, the first center bypass line 342 may be closed so that the hydraulic fluid from the first hydraulic pump 200 may not be supplied to the bucket cylinder. When a pilot signal pressure is not supplied to the first swing control valve 310 and the first boom control valve 312, the first center bypass line 342 may be opened so that the hydraulic fluid from the first hydraulic pump 200 may be supplied to the bucket cylinder.

Alternatively, the control valves 320, 322, 324 and 326 installed in the second center bypass line 352 may be connected parallel with each other to the second hydraulic pump 202 by the second branch hydraulic line 354. Thus, when an operator manipulates the bucket lever for the bucket crowd operation, regardless of a manipulation of any other actuator lever, the hydraulic fluid from the second hydraulic pump 202 may be supplied to the bucket cylinder through the second bucket control valve 326.

Referring again to FIG. 5, when an operator manipulates a swing lever and a bucket lever for a bucket crowd operation without a boom raising manipulation, the control unit 600 may close the shutoff valve 500 and a swing pilot signal pressure from the pressure generating device 700 may be supplied to the swing control valve 310 to thereby shift the swing control valve 310. As the swing control valve 310 is shifted, the hydraulic fluid from the first hydraulic pump 200 may be supplied to the swing motor 800 and the first center bypass line 342 may be closed to shut off communication with the first hydraulic pump 200. The first boom control valve 312 may be connected parallel with the swing control valve 310 to the first hydraulic pump 200 by the first branch hydraulic line 344, while the first bucket control valve 314 may not be connected parallel with the swing control valve 310 to the first hydraulic pump 200. Accordingly, in this case, the hydraulic fluid from the first hydraulic pump 200 may not be supplied to the first bucket control valve 314, and thus, all the hydraulic fluid from the first hydraulic pump 200 may be used to drive the swing motor 800. That is, in the case that there is no boom raising and swing operations signal, the hydraulic fluid from the first hydraulic pump 200 may be supplied to the bucket through the first bucket control valve 314.

Figure 6:
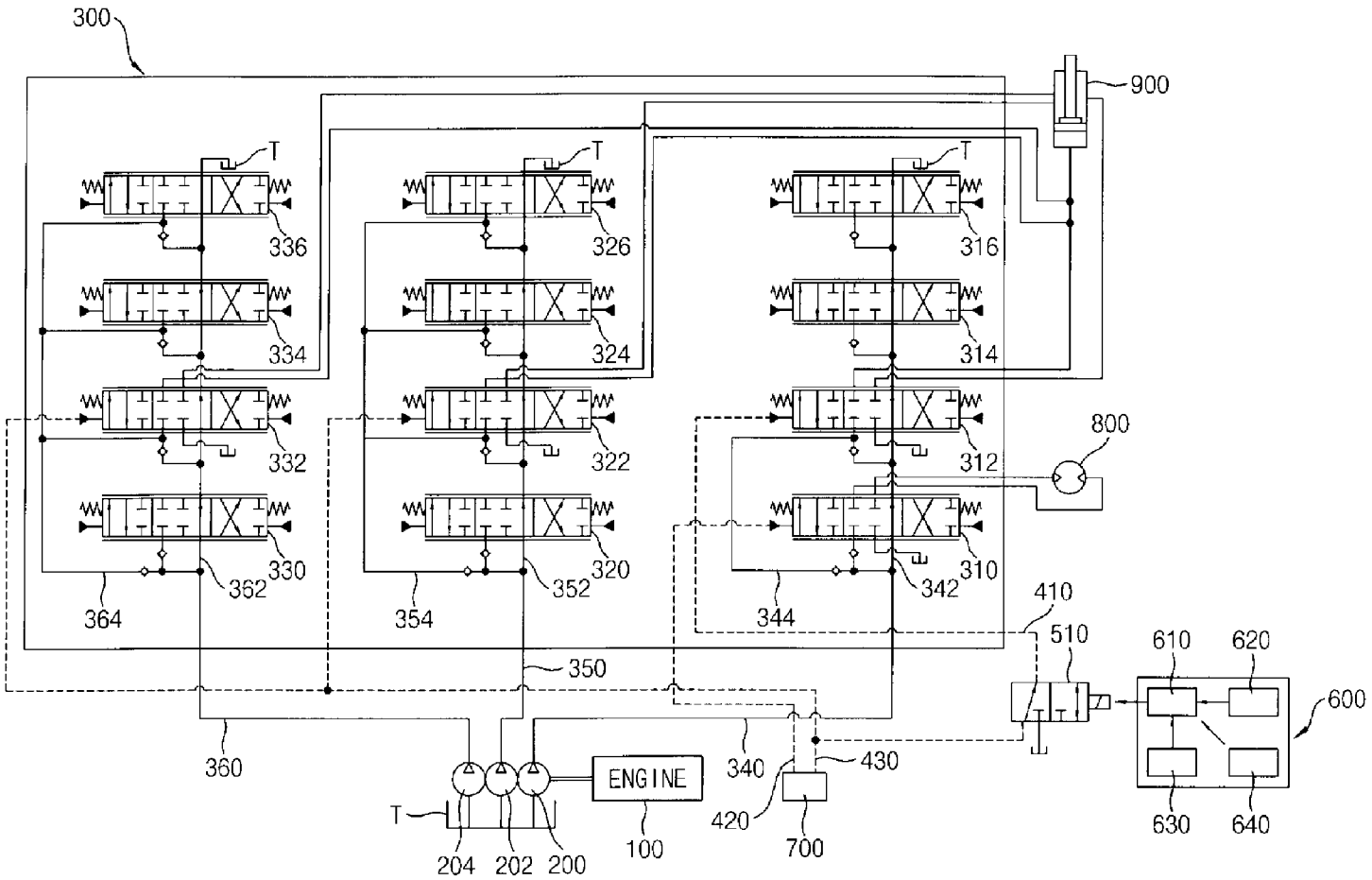
Figure 7:
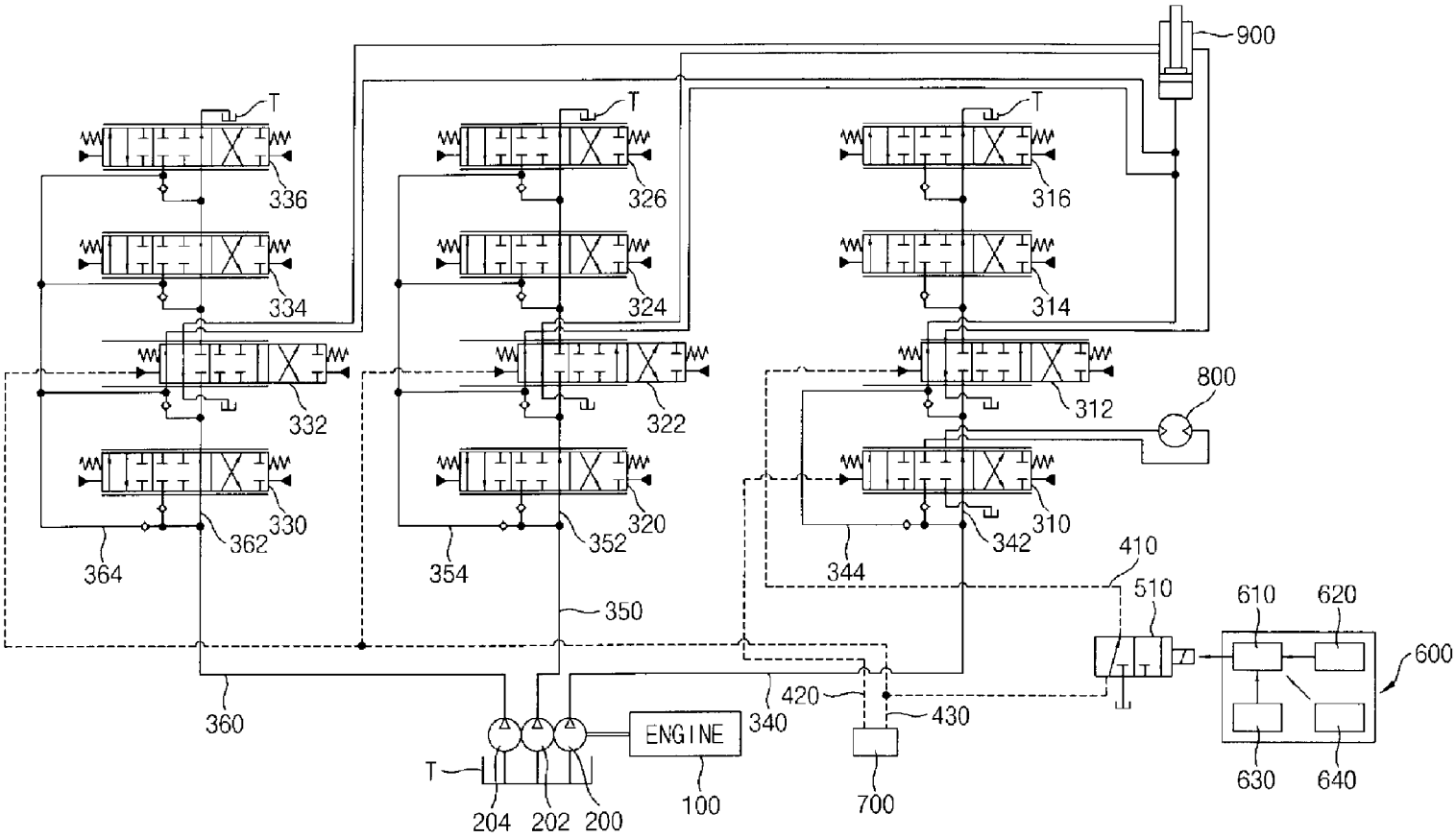
Figure 8:
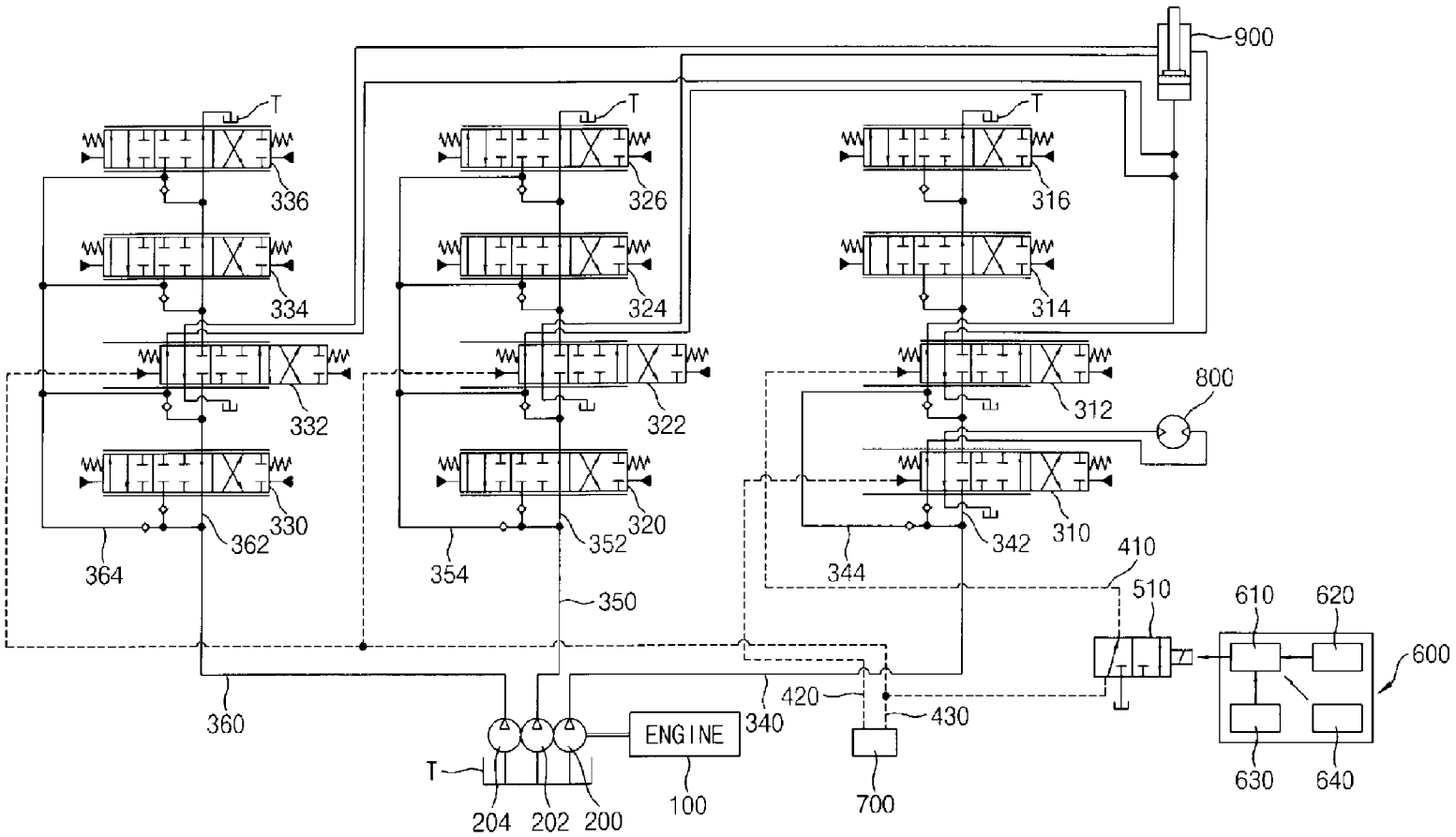
Figure 9:
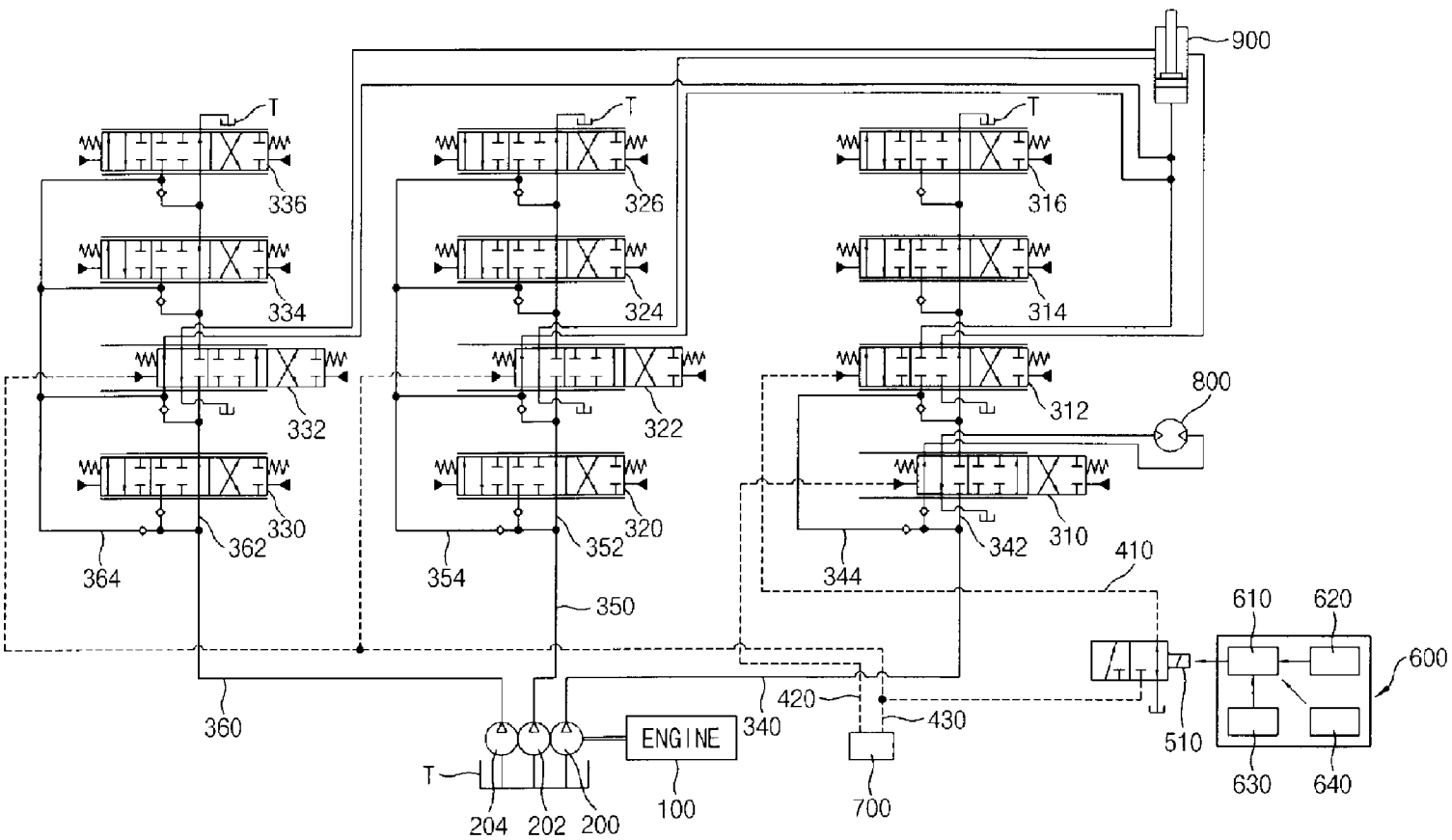
Figure 10:
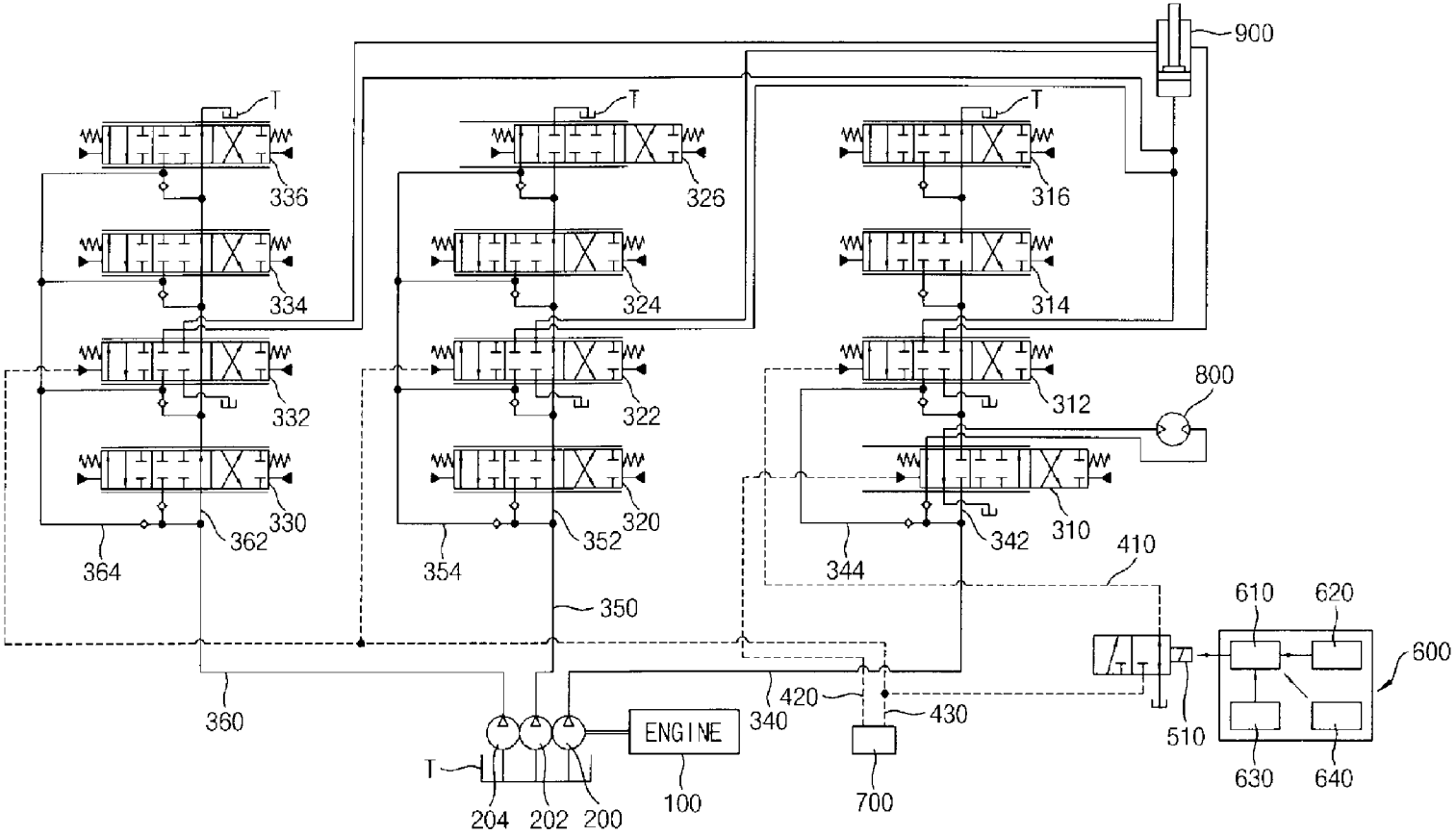

FIG. 6 is a hydraulic circuit diagram illustrating a control system for construction machinery in accordance with example embodiments. FIG. 7 is a hydraulic circuit diagram illustrating the control system for construction machinery in FIG. 6, when receiving a boom raising signal in case that a swing operation priority mode is not selected. FIG. 8 is a hydraulic circuit diagram illustrating the control system for construction machinery in FIG. 6, when receiving a multiple manipulation signal of boom raising and swing operations in case that a swing operation priority mode is not selected. FIG. 9 is a hydraulic circuit diagram illustrating the control system for construction machinery in FIG. 6, when receiving a multiple manipulation signal of boom raising and swing operations in case that a swing operation priority mode is selected. FIG. 10 is a hydraulic circuit diagram illustrating the control system for construction machinery in FIG. 6, when receiving only a swing operating signal without a boom raising signal. The control system for construction machinery may be substantially the same as or similar to the control system as described with reference to FIGS. 1 to 5, except for a construction of a shutoff valve. Thus, same reference numerals will be used to refer to the same or like elements and any further repetitive explanation concerning the above elements will be omitted.

Referring to FIGS. 6 to 10, a control system for construction machinery according to example embodiments may include first to third hydraulic pumps 200, 202 and 204 and a pilot pump 210 connected to an engine 100, a main control valve 300 configured to adjust a flow of a hydraulic fluid from the first to third hydraulic pumps 200, 202 and 204 to control operations of actuators in the construction machinery, a pressure generating device 700 configured to receive a control fluid from the pilot pump 210 and generate a pilot signal pressure for controlling the main control valve 300, a shutoff valve 510 configured to selectively open and close a first boom raising control line 410 through which a boom raising pilot signal pressure is applied to a first boom control valve 312 of the main control valve 300, and a control unit 600 configured to electronically control the shutoff valve 510.

In example embodiments, the shutoff valve 510 may include a solenoid valve.

The solenoid valve may be different from the electronic proportional pressure reducing (EPPR) valve in that the solenoid valve cannot control a magnitude of a boom raising pilot signal pressure to be supplied through the first boom raising control line 410 in response to intensity of a current applied from the control unit 600. Accordingly, the shutoff valve 510 may not receive the control fluid directly from the pilot pump 210, but may receive the control fluid from the pressure generating device 700. The pressure generating device 700 may generate a boom raising pilot signal pressure in response to a boom raising operation manipulation of an operator and may supply to the first to third boom control valves 312, 322 and 332. The control unit 600 may control on/off functions of the shutoff valve 510.

When a current is applied to the shutoff valve 510 from the control unit 600, the shutoff valve 510 may be opened to supply the boom raising pilot signal pressure to the first boom control valve 312. When the current is shut off to the shutoff valve 510, the shutoff valve 510 is closed to shut off the boom raising pilot signal pressure to the first boom raising control valve 312, and thus the first boom control valve 312 may be shifted to a neutral position.

As illustrated in FIG. 7, when an operator manipulates a boom lever for raising the boom, the pressure generating device 700 may receive the control fluid from the pilot pump 210 and generate a boom raising pilot signal pressure corresponding to a manipulation amount of the operator. The boom raising pilot signal pressure may be supplied to second and third control valves 322 and 332 through a second boom raising control line 430. Thus, the second and third boom control valves 322 and 332 may be shifted to supply the hydraulic fluid to the boom cylinder 900.

Additionally, in case that a swing operation priority mode is not selected by a selection switch 620, the control unit 600 may open the shutoff valve 510, to supply the boom raising pilot signal pressure supplied through the second boom raising control line 430 from the pressure generating device 700 to the first boom control valve 312. Thus, the first boom control valve 312 may be shifted to supply the hydraulic fluid discharged from the first hydraulic pump 200 to the boom cylinder 900, thereby obtaining a greater pump power than when only the second and third hydraulic pumps 202 and 204 are used to supply the hydraulic fluid to the boom cylinder 900.

As illustrated in FIG. 8, when a controller 610 receives a boom raising operation manipulation signal and a swing operation manipulation signal from first and second pressure sensors 630 and 640 in case that an operator turns off the selection switch 620 such that a swing operation priority mode is not selected, the controller 610 may control to open the shutoff valve 510. As the shutoff valve 510 is opened, a boom raising pilot signal pressure generated in the pressure generating device 700 may be supplied to the first boom control valve through the shutoff valve 510 and the first boom raising control line 410. Thus, the first boom control valve 312 may be shifted to supply the hydraulic fluid from the first hydraulic pump 200 to the boom cylinder 900. Additionally, a swing pilot signal pressure generated in the pressure generating device may be supplied to a swing control valve 310 via a swing control line 420. Thus, the swing control valve 310 may be shifted to supply the hydraulic fluid from the first hydraulic pump 200 to the swing motor 800. That is, the hydraulic fluid from the first hydraulic pump 200 may be used to drive the swing motor 800 and the boom cylinder 900.

Alternatively, as illustrated in FIG. 9, in case that an operator turns on the selection switch 620 such that the swing operation priority mode is selected, the controller 610 may control to close the shutoff valve 510 such that the boom raising pilot signal pressure may not be supplied to the first boom control valve 312. Accordingly, the first boom control valve 312 may be shifted to a neutral position.

That is, when an operator selects the swing operation priority mode, the boom raising pilot signal pressure may be shut off to the first boom control valve 312, and thus, all the hydraulic fluid from the first hydraulic pump 200 may be used to drive the swing motor 800 to thereby secure independence of the swing operation.

As illustrated in FIG. 10, when an operator manipulates a swing lever and a bucket lever for a bucket crowd operation without a boom raising manipulation, all the hydraulic fluid from the first hydraulic pump 200 may be supplied to the swing motor 800.

In particular, the swing control valve 310, the first boom control valve 312 and a first bucket control valve 314 may be installed in a first center bypass line 342 divided from a first hydraulic line 340, and the swing control valve 310 and the first boom control valve 312 may be connected parallel with each other to the first hydraulic pump 200 by a first branch hydraulic line 344. Accordingly, when a pilot signal pressure is supplied to any one of the first swing control valve 310 or the first boom control valve 312, the first center bypass line 342 may be closed so that the hydraulic fluid from the first hydraulic pump 200 may not be supplied to a bucket cylinder (not illustrated). When a pilot signal pressure is not supplied to the first swing control valve 310 and the first boom control valve 312, the first center bypass line 342 may be opened so that the hydraulic fluid from the first hydraulic pump 200 may be supplied to the bucket cylinder.

Alternatively, control valves 320, 322, 324 and 326 installed in a second center bypass line 352 may be connected parallel with each other to a second hydraulic pump 202 by a second branch hydraulic line 354. Thus, when an operator manipulates the bucket lever for the bucket crowd operation, regardless of a manipulation of any other actuator lever, the hydraulic fluid from the second hydraulic pump 202 may be supplied to the bucket cylinder through the second bucket control valve 326.

As mentioned above, the control system for construction machinery in accordance with example embodiments may drive the swing motor 800 and the boom cylinder 900 together using the hydraulic fluid discharged from the first hydraulic pump 200. That is, because all three hydraulic pumps 200, 202 and 204 are used to raise the boom, a greater boom raising power may be obtained compared with when using two hydraulic pumps 202 and 204.

Further, when an operator selects a swing operation priority mode by the selection switch 620, all the hydraulic fluid from the first hydraulic pump 200 may be used to drive the swing motor to thereby secure independence of the swing operation.

Hereinafter, a method of controlling construction machinery using the control system in FIG. 1 will be explained.

Figure 11:
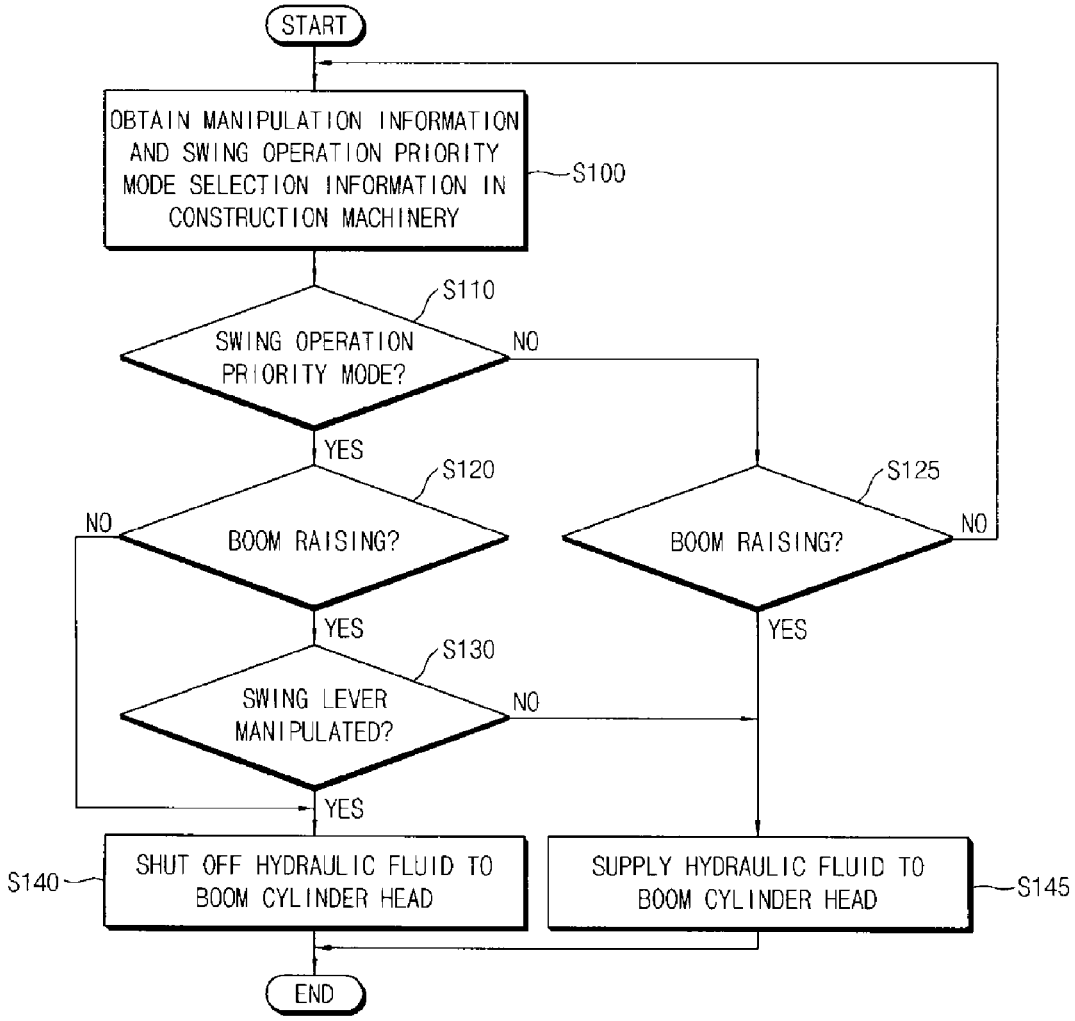

FIG. 11 is a flow chart illustrating a method of controlling construction machinery in accordance with example embodiments.

Referring to FIG. 11, first, manipulation information and swing operation priority mode selection information in construction machinery may be obtained (S100).

In example embodiments, the manipulation information may include information of a boom raising pilot signal pressure supplied to a main control valve 300 and information of a swing pilot signal pressure supplied to the main control valve 300.

For example, a magnitude of the boom raising pilot signal pressure supplied to second and third boom control valves 322 and 332 may be obtained from a first pressure sensor 630 installed in a second boom raising control line 430, and a magnitude of the swing pilot signal pressure supplied to a swing control valve 310 may be obtained from a second pressure sensor 640 installed in a swing control line 420.

In example embodiments, the swing operation priority mode selection information may be obtained by a selection switch 620.

For example, if the selection switch 620 turns on, it may be determined that a swing operation priority mode is selected. If the selection switch 620 turns off, it may be determined that the swing operation priority mode is not selected.

Then, whether or not the swing operation priority mode is selected may be determined (S110) and whether or not the boom lever for raising a boom is manipulated may be determined (S120, S125).

In case that the swing operation priority mode is not selected, when a boom raising manipulation signal is inputted, a hydraulic fluid may be supplied to a boom cylinder head (S145).

In particular, a control unit 600 may open a shutoff valve 500 to supply the boom raising pilot signal pressure to a first boom control valve 312. Thus, all the hydraulic fluid from a first hydraulic pump 200 may be supplied to the boom cylinder head to raise the boom, as illustrated in FIG. 2.

In case that the swing operation priority mode is selected, when a boom raising operation manipulation signal and a swing operation manipulation signal are inputted, the hydraulic fluid may be shut off to the boom cylinder head (S140).

In particular, the control unit 600 may close the shutoff valve 500 to shut off the boom raising pilot signal pressure to the first boom control valve 312. Thus, the first boom control valve 312 may be shifted to a neutral position, all the hydraulic fluid from the first hydraulic pump 200 may be used to drive a swing motor 800, as illustrated in FIG. 4.

That is, in a multiple manipulation of boom raising and swing operations, when an operator selects the swing operation priority mode, the swing operation may be given more priority than the boom raising operation, to thereby obtain independence of the swing operation.

In case that the swing operation priority mode is selected, when a boom raising operation manipulation signal is not inputted, the hydraulic fluid may be shut off to the boom cylinder head (S140). This is because the boom raising pilot signal pressure is not supplied to the first boom control valve 312 when the boom lever is not manipulated.

In case that the swing operation priority mode is selected, when a boom raising manipulation signal is inputted and a swing operation manipulation signal is not inputted, a hydraulic fluid may be supplied to a boom cylinder head (S145).

Because it may not be required to give more priority to the swing operation than the boom raising operation, even though the swing operation priority mode is selected, the shutoff valve 500 may not be closed. Thus, all the hydraulic fluid discharged from the first hydraulic pump 200 may be used to raise the boom, thereby obtaining a greater pump power than when using only the second and third hydraulic pumps 202 and 204.

The foregoing is illustrative of example embodiments and is not to be construed as limiting thereof. Although a few example embodiments have been described, those skilled in the art will readily appreciate that many modifications are possible in example embodiments without materially departing from the novel teachings and advantages of the present invention. Accordingly, all such modifications are intended to be included within the scope of example embodiments as defined in the claims.

What is claimed is:

1. A control system for construction machinery, comprising:

first and second hydraulic pumps connected to an engine;

a swing control valve and a first boom control valve installed in a first center bypass line connected to the first hydraulic pump and connected parallel with each other to the first hydraulic pump by a parallel line, the swing control valve configured to control a drive of a swing motor, the first boom control valve configured to control a drive of a boom cylinder;

a second boom control valve installed in a second center bypass line connected to the second hydraulic pump, the second boom control valve configured to control the drive of the boom cylinder;

a shutoff valve installed in a control line through which a boom raising pilot signal pressure for raising a boom of the boom cylinder is supplied to the first boom control valve and configured to selectively open and close the control line; and a control unit configured to electronically control the shutoff valve according to a manipulation signal in the construction machinery, wherein the control unit closes the shutoff valve such that the first boom control valve is shifted to a neutral position when a swing operation priority mode is selected, wherein the control unit comprises a selection switch for selecting the swing operation priority mode, and a controller configured to receive the manipulation signal in the construction machinery and a selection signal from the selection switch and apply a current to the shutoff valve.

2. The control system of claim 1, wherein the swing control valve is installed in the most upstream portion of the first center bypass line towards the first hydraulic pump.

3. The control system of claim 1, further comprising at least one actuator control valve installed in the first center bypass line downstream next to the swing control valve and the first boom control valve, and configured to control a drive of an actuator in the construction machinery.

4. The control system of claim 3, wherein the actuator control valve is connected in series with the swing control valve and the first boom control valve.

5. The control system of claim 1, further comprising a third hydraulic pump connected to the engine; and a third boom control valve installed in a third center bypass line connected to the third hydraulic pump, the third boom control valve configured to control the drive of the boom cylinder.

6. The control system of claim 1, wherein the control unit further comprises a first pressure sensor configured to detect a boom raising pilot signal pressure supplied to the second boom control valve in order to raise the boom of the boom cylinder; and a second pressure sensor configured to detect a swing pilot signal pressure supplied to the swing control valve in order to drive the swing motor.

7. The control system of claim 6, wherein the control unit opens the shutoff valve when receiving a boom raising manipulation signal from the first pressure sensor in case that the swing operation priority mode is not selected.

8. The control system of claim 1, further comprising a pilot pump connected to the engine; and a pressure generating device configured to receive a control fluid from the pilot pump and generate the boom raising pilot signal pressure and the swing pilot signal pressure corresponding to the manipulation signal.

9. The control system of claim 1, wherein the shutoff valve comprises electronic proportional pressure reducing (EPPR) valve.

10. The control system of claim 1, wherein the shutoff valve comprises a solenoid valve.

11. A control system for construction machinery, the control system comprising:

first and second hydraulic pumps connected to an engine;

a swing control valve installed in an upstream portion of a first center bypass line connected to the first hydraulic pump, the swing control valve configured to control a drive of a swing motor;

a first boom control valve installed downstream in the first center bypass line next to the swing control valve, the first boom control valve configured to control a drive of a boom cylinder;

a second boom control valve installed in a second center bypass line connected to the second hydraulic pump, the second boom control valve configured to control the drive of the boom cylinder;

a shutoff valve installed in a control line through which a boom raising pilot signal pressure for raising a boom of the boom cylinder is supplied to the first boom control valve and configured to selectively open and close the control line; and a control unit including a first pressure sensor for detecting a boom raising pilot signal pressure supplied to the second boom control valve, a second pressure sensor for detecting a swing pilot signal pressure supplied to the swing control valve, a selection switch for selecting a swing operation priority mode, and a controller configured to receive pressure information and a selection signal from the first and second pressure sensors and the selection switch and electronically control the shutoff valve, wherein the controller closes the shutoff valve such that the first boom control valve is shifted to a neutral position when the swing operation priority mode is selected, wherein the swing control valve and the first boom control valve are connected parallel with each other to the first hydraulic pump by a parallel line.

12. A method for controlling construction machinery, the method comprising:

obtaining manipulation information;

receiving a selection signal from a selection switch for selecting a swing operation priority mode to obtain swing operation priority mode selection information in construction machinery;

supplying a hydraulic fluid to a boom cylinder head when receiving a boom raising manipulation signal in case a swing operation priority mode is not selected; and shutting off the hydraulic fluid to the boom cylinder head when receiving the boom raising operation manipulation signal and a swing operation manipulation signal in case the swing operation priority mode is selected, wherein a control system for the construction machinery includes a swing control valve and a first boom control valve installed in a first center bypass line connected to a first hydraulic pump and connected parallel with each other to the first hydraulic pump by a parallel line, and a second boom control valve installed in a second center bypass line connected to a second hydraulic pump, the swing control valve configured to control a drive of a swing motor, the first boom control valve configured to control a drive of a boom cylinder, the second boom control valve configured to control the drive of the boom cylinder, wherein shutting off the hydraulic fluid to the boom cylinder head comprises closing a shutoff valve that is installed in a control line through which a boom raising pilot signal pressure for raising a boom of the boom cylinder is supplied to the first boom control valve, to close the control line such that the first boom control valve is shifted to a neutral position.

13. The method of claim 12, wherein obtaining the manipulation information comprises obtaining information of a boom raising pilot signal pressure supplied to a main control valve; and obtaining information of a swing pilot signal pressure supplied to the main control valve.

* * * * *